US008281466B2

(12) United States Patent
Elhaj

(10) Patent No.: US 8,281,466 B2
(45) Date of Patent: Oct. 9, 2012

(54) BROKEN HEART SHAPED URN

(76) Inventor: Antoine Elhaj, Sandusky, OH (US)

( * ) Notice: Subject to any disclaimer, the term of this patent is extended or adjusted under 35 U.S.C. 154(b) by 0 days.

(21) Appl. No.: 13/194,914

(22) Filed: Jul. 30, 2011

(65) Prior Publication Data

US 2011/0283497 A1 Nov. 24, 2011

Related U.S. Application Data

(63) Continuation-in-part of application No. 29/385,636, filed on Feb. 17, 2011, now Pat. No. Des. 652,195, which is a continuation of application No. 12/430,882, filed on Apr. 27, 2009, now Pat. No. 7,921,528, and a continuation of application No. 12/390,400, filed on Feb. 20, 2009, now Pat. No. 7,900,326.

(51) Int. Cl.
*A61G 17/00* (2006.01)

(52) U.S. Cl. ..... 27/1

(58) Field of Classification Search ..... 27/1, 35; D99/5; 63/1.14, 18, 19; 220/23.2, 23.4, 220/23.83, 501, 505, 553; 52/136
See application file for complete search history.

(56) References Cited

U.S. PATENT DOCUMENTS

| | | | | | |
|---|---|---|---|---|---|
| D355,065 | S | * | 1/1995 | Hicks | D99/5 |
| D375,456 | S | * | 11/1996 | Borgmann | D9/629 |
| 5,832,575 | A | * | 11/1998 | Sturino | 27/1 |
| D437,670 | S | * | 2/2001 | Rivera et al. | D99/5 |
| D470,991 | S | * | 2/2003 | Goldstein | D99/5 |
| D476,130 | S | * | 6/2003 | Joy et al. | D99/5 |
| D515,267 | S | * | 2/2006 | Wozniak | D99/5 |
| D543,005 | S | * | 5/2007 | Pertz | D99/5 |
| 7,882,606 | B2 | * | 2/2011 | Elhaj | 27/27 |
| 7,900,327 | B2 | * | 3/2011 | Elhaj | 27/35 |
| 2006/0266079 | A1 | * | 11/2006 | Lavictoire | 63/18 |
| 2010/0043187 | A1 | * | 2/2010 | Steuer et al. | 27/1 |
| 2010/0313395 | A1 | * | 12/2010 | Heckenbach | 27/1 |

* cited by examiner

*Primary Examiner* — William L. Miller

(74) *Attorney, Agent, or Firm* — Ronald J. Koch

(57) ABSTRACT

Complementary broken heart shaped urns for storing ashes of the deceased having multiple chambers in an upper heart shaped portion as well is in a lower portion that also serves as the base whereby multiple cremated remains can be stored.

2 Claims, 3 Drawing Sheets

BROKEN HEART SHAPED URN

CROSS REFERENCE TO RELATED APPLICATIONS

The present application is a continuation in part of application Ser. No. 29/385,636, now U.S. Pat. D652195 of ANTOINE ELHAJ filed Feb. 17, 2011, which is a continuation of application Ser. No. 12/430,882, now U.S. Pat. No. 7,921,528 of ANTOINE ELHAJ filed Feb. 27, 2009 and application Ser. No. 12/390,400, now U.S. Pat. No. 7,900,326 of ANTOINE ELHAJ filed Feb. 20, 2009, and based on which priority is herewith claimed under 35 U.S.C. 120 and the disclosures of which is incorporated herein by reference in its entirety as if fully rewritten herein.

The present application is related to U.S. Pat. D611,675 of ANTOINE ELHAJ filed Feb. 21, 2009, and the disclosure of which is incorporated herein by reference in its entirety as if fully rewritten herein.

The present application is related to U.S. Pat. No. 7,950,117 of ANTOINE ELHAJ filed Jul. 2, 2009, and the disclosure of which is incorporated herein by reference in its entirety as if fully rewritten herein.

BACKGROUND AND SUMMARY

The present invention relates generally to urns and specifically to urns having multiple chambers for storing two or more cremated remains. The present invention allows the cremated remains of two or more deceased to be perpetually stored together in a distinctively shaped urn.

REFERENCE NUMERALS IN DRAWINGS

Figure 2:
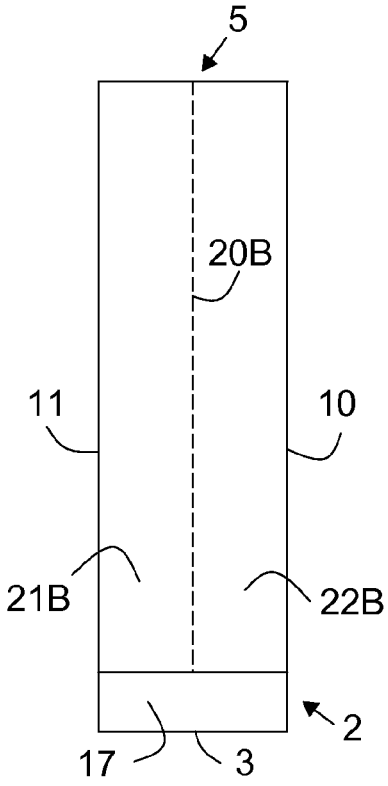
FIG. 2 depicts a side view of the invention.
Figure 1:
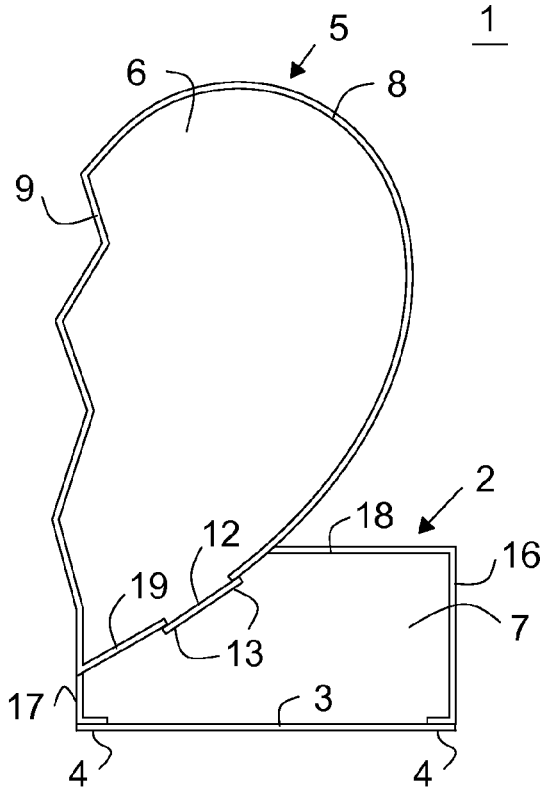
FIG. 1 depicts a front cross-sectional view of the invention.
Figure 3:
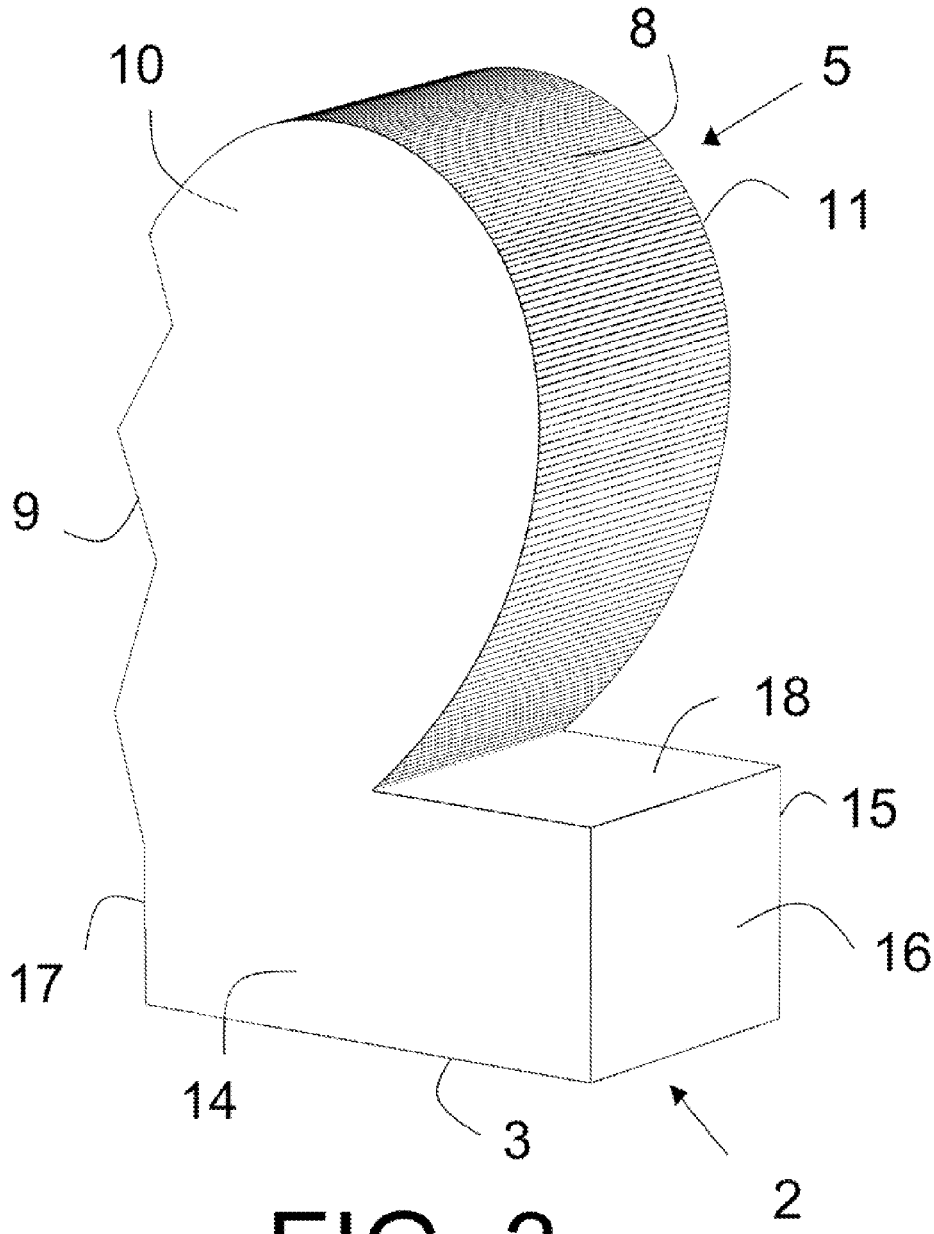
FIG. 3 depicts a rear perspective view of the invention.

The table below lists the reference numerals employed in the figures, and identifies the element designated by each numeral.

1 urn 1
2 lower chamber 2
3 cover plate 3 of lower chamber 2
4 screws 4 of first cover plate 3 of lower chamber 2
5 upper chamber 5
6 interior portion 6 of upper chamber 5
7 interior portion 7 of lower chamber 2
8 curved outer surface 8 of upper chamber 5
9 jagged inner surface 9 of upper chamber 5
10 front vertical wall 10 of upper chamber 5
11 rear vertical wall 11 of upper chamber 5
12 cover plate 12 of upper chamber 5
13 screws 13 of second cover plate 12 of upper chamber 5
14 front vertical wall 14 of lower chamber 2
15 rear vertical wall 15 of lower chamber 2
16 vertical outer surface 16 of lower chamber 2
17 vertical inner surface 17 of lower chamber 2
18 horizontal upper surface 18 of lower chamber 2
19 lower portion 19 of curved outer surface 8 of upper chamber 5
20B vertical dividing wall 20B of interior portion 6 of upper chamber 5

21B first sub-chamber 21B of interior portion 6 of upper chamber 5
22B second sub-chamber 22B of interior portion 6 of upper chamber 5
23C jagged inner surface 23C of second urn
24C vertical inner surface 24C of second urn
30C second urn 30C

DETAILED DESCRIPTION

In one embodiment, a broken heart shaped urn 1 for storing ashes of the deceased comprises upper and lower chambers 5 & 2, respectively. Upper chamber 5 has curved outer surface 8 which forms a half heart shape, jagged inner surface 9, front and rear vertical walls 10 & 11, respectively, and cover plate 12.

Cover plate 12 is releasably attached to an opening in lower portion 19 of curved outer surface 8 of upper chamber 5 by screws 13. Curved outer surface 8, jagged inner surface 9, front and rear vertical walls 10 & 11, and cover plate 12 all cooperate to form upper chamber 5 which forms interior portion 6.

Lower chamber 2 has front vertical wall 14, rear vertical wall 15, vertical outer surface 16, horizontal upper surface 18, vertical inner surface 17, and cover plate 3. Front vertical wall 14, rear vertical wall 15, vertical outer surface 16, horizontal upper surface 18, vertical inner surface 17, cover plate 3, and lower portion 19 of curved outer surface 8 of upper chamber 5 all cooperate to form lower chamber 2 which forms interior portion 7. Lower chamber 2 also serves as the urn base.

Interior portion 7 of lower chamber 2 is accessed via cover plate 3 of lower chamber 2. Cover plate 3 is releasably attached by screws 4. Interior portion 6 of upper chamber 5 is accessed via cover plate 12 (accessible through interior portion 7 of lower chamber 2) of upper chamber 5.

In operation, an inner plastic liner (not shown) is inserted into interior portion 6 of upper chamber 5 via the opening in lower portion 19 of curved outer surface 8 of upper chamber 5. Ashes are then dispensed into the plastic liner through a funnel. The liner is then sealed with a tie wrap or other suitable means. Cover plate 12 of upper chamber 5 is then secured in place to seal the ashes in interior portion 6 of upper chamber 5. Thereafter, a second plastic liner is inserted into interior portion 7 of lower chamber 2 and filled with ashes. Cover plate 3 of lower chamber 2 is then secured in place. Thus, two separate remains are stored in urn 1.

In one embodiment (FIG. 2), vertical dividing wall 20B is affixed within interior portion 6 of the upper chamber 5 to create first and second sub-chambers 21B & 22B, respectively. Vertical dividing wall 20B is affixed such that cover plate 12 of upper chamber 5 allows access to first and second sub-chambers 21B & 22B, respectively.

In this embodiment, 3 separate compartments are created: 2 within interior portion 6 of upper chamber 5 and one within interior portion 7 of lower chamber 2. Plastic liners are inserted into each of the compartments as described herein. Thus, three separate remains are stored in urn 1.

Figure 4:
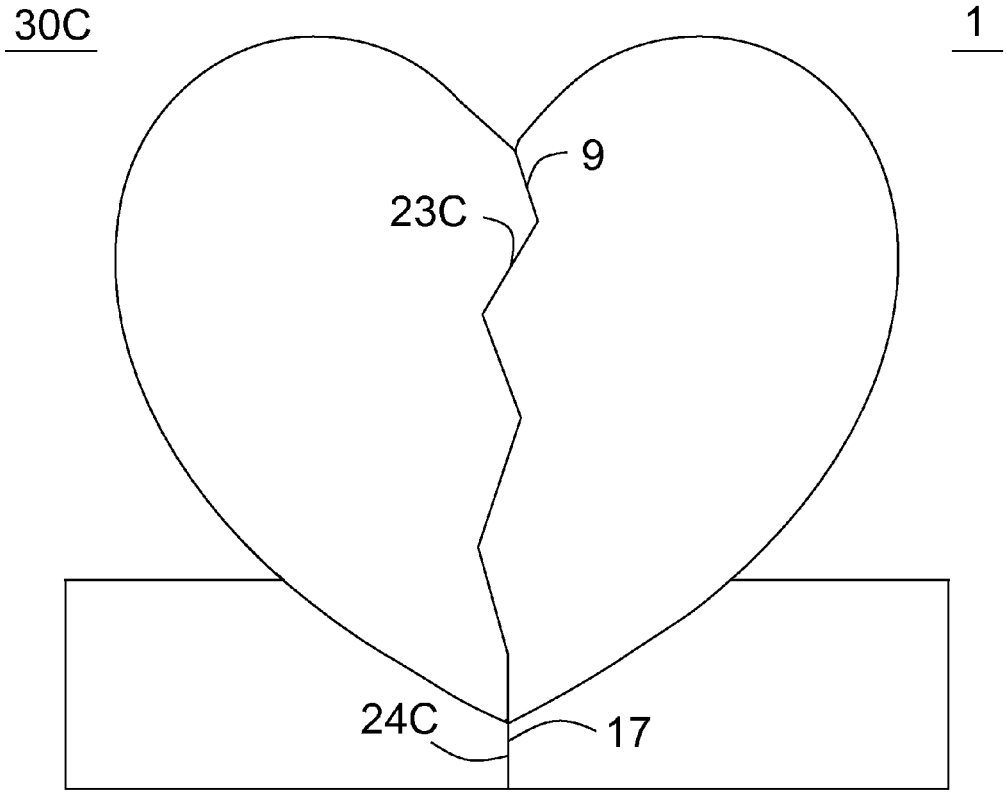
FIG. 4 depicts a front view of the invention.

In one embodiment (FIG. 4), second broken heart shaped urn 30C cooperatively abuts urn 1, wherein jagged inner surface 23C cooperatively abuts jagged inner surface 9 of upper chamber 5, and vertical inner surface 24C cooperatively abuts vertical inner surface 17 of lower chamber 2. Urn 30C is substantially the same in design as urn 1 except for jagged inner surface 23C which must be shaped for a cooperating fit. Thus, urns 1 & 30C fit together to form a heart shape. Collectively, as many as 6 separate remains can be stored depending on the configuration.

In one embodiment, an air-tight seal is utilized in securing each of cover plate 3 of lower chamber 2 & cover plate 12 of upper chamber 5 according to conventional methods for achieving such seals. Additionally, conventional casket sealers can be used on the various joints, openings, and seals.

The urns can be made of various materials including but not limited to cultured marble, wood, fiberglass, and other materials with sufficient strength and rigidity. One of of skill in the art would appreciate the various amounts of cremated remains that are created by various persons and animals. Accordingly, the urns in their various embodiments of the present invention can be sized accordingly. For example, some conventional urns are sized to hold 220 cubic inches of ash for persons and 80 cubic inches of ash for dogs. It is preferred that the height of the base (i.e. vertical outer surface 16 of lower chamber 2) not be greater than 30% of the height of the entire urn.

Although the spirit of the invention relates to heart shapes, one of skill in the art would appreciate that the invention is not limited to heart shapes, and that many other shapes could be utilized.

What is claimed is:

1. A broken heart shaped urn for storing ashes of the deceased comprising:

upper and lower chambers;

the upper chamber having, a curved outer surface forming a half heart shape, a lower portion of the curved outer surface having an opening for insertion of the ashes of the deceased, a jagged inner surface, a front vertical wall, a rear vertical wall, and a removable cover plate for closing the opening, wherein the curved outer surface, jagged inner surface, front and rear vertical walls, and cover plate cooperate to form the upper chamber having an interior portion for storing the ashes of the deceased;

the lower chamber having, a front vertical wall, a rear vertical wall, a vertical outer surface, an horizontal upper surface, a vertical inner surface, an open bottom for insertion of the ashes of the deceased, a removable cover plate for closing the open bottom, wherein the front vertical wall, rear vertical wall, vertical outer surface, horizontal upper surface, vertical inner surface, cover plate, and the lower portion of the curved outer surface of the upper chamber, including its cover plate, cooperate to form the lower chamber having an interior portion for storing the ashes of the deceased;

whereby the jagged inner surface of the upper chamber is placed adjacent a complementary jagged surface of a second broken heart shaped urn to form a complementary fit.

2. The broken heart shaped urn of claim 1 further comprising:

a vertical dividing wall affixed within the interior portion of the upper chamber to create first and second sub-chambers.

* * * * *